United States Patent [19]

Blevins

[11] Patent Number: 4,825,618

[45] Date of Patent: May 2, 1989

[54] OVERLAPPING TILE

[76] Inventor: Jerry L. Blevins, P.O. Box 952, Olney, Md. 20832

[21] Appl. No.: 143,021

[22] Filed: Jan. 12, 1988

[51] Int. Cl.[4] ..... E04C 1/10

[52] U.S. Cl. ..... 52/595; 52/541; 52/535

[58] Field of Search ..... 52/535, 539, 541, 595, 52/592, 540

[56] References Cited

U.S. PATENT DOCUMENTS

| | | | |
|---|---|---|---|
| 294,855 | 3/1884 | Crawford | 52/539 |
| 347,425 | 8/1886 | Hall | 52/589 |
| 1,516,025 | 11/1924 | Molnar et al. | 52/589 |
| 2,323,417 | 7/1943 | Pauli, Jr. | 52/589 |
| 2,693,102 | 11/1954 | Luster et al. | 52/589 |
| 3,444,660 | 5/1969 | Feichter et al. | 52/589 |
| 4,292,776 | 10/1981 | MacDonald | 52/539 |

FOREIGN PATENT DOCUMENTS

| | | | |
|---|---|---|---|
| 8918 | of 1898 | United Kingdom | 52/541 |
| 237460 | 7/1925 | United Kingdom | 52/539 |

OTHER PUBLICATIONS

Audel's Carpenter's and Builder's Guides ©1923, Theo Aadel Co., Th 145 Q7 V4 1945.

*Primary Examiner*—Henry E. Raduazo
*Attorney, Agent, or Firm*—Indyk, Pojunas & Brady

[57] ABSTRACT

Tiles 60 inches long fit on a wall along the length of a standard bathtub, and when cut in half, fit on walls at ends of a standard bathtub. Each tile has a lip and flange that overlap adjacent tiles in a way that makes grouting unnecessay between adjacent tiles. A mastic bead between adjacent tiles is hidden from view and seals out moisture. An edge of a tile front surface slopes down from the flange of one tile to drain moisture away from the lip and flange. The lip and flange also abut in a way that aligns one tile with another.

12 Claims, 2 Drawing Sheets

OVERLAPPING TILE

This invention concerns a covering for a planar surface. More specifically, this invention concerns a tile for covering a wall.

BACKGROUND OF THE INVENTION

Tiles have commonly been used to cover and protect interior walls from the effects of moisture. These tiles are usually square. U.S. Pat. Nos. 1,516,025;, 2,323,471; 2,693,102; and 3,444,660 concern square wall tiles that interlock.

To apply tiles to a wall surface, a worker applied an adhesive or mastic to the wall. The worker then applied each tile to the adhesive with spaces between adjacent tiles. The worker aligned the tiles horizontally and vertically for a neat appearance. However, it was very easy to apply the tiles in a crooked and unsightly manner. The worker usually applied grout in the spaces between each tile. Thus, a substantial amount of labor was involved in grouting and aligning these tiles.

U.S. Pat. No. 2,693,102 also describes tiles that have interlocking tabs and slots and indicates that grout joints are absent. However, it is difficult and costly to manufacture tiles with tabs and slots. Also, moisture can leak between and behind these tiles.

Oblong tiles have also been proposed. U.S. Pat. Nos. 347,425 and 2,323,417 concern tiles that may be oblong, for instance.

None of these tiles has a simple and effective device for aligning adjacent tiles and for draining moisture away from joints between adjacent tiles.

SUMMARY OF THE INVENTION

The invention concerns tile comprising a body having a back surface in a back plane, a front surface in a front plane, and a center plane between and parallel to the back plane and front plane. The tile also includes a means for aligning one tile with another which comprises a flange extending from the body between the back plane and the center plane and having a top surface, a lip extending from the body in a direction opposite of the flange and between the center plane and the front plane, and a bottom surface that joins the lip to the back suface. Also, the top surface of a flange of one tile comprises a means for abutting the bottom surface that joins the lip of another tile, such that the flange of one tile is adjacent the lip of another tile. In addition, the invention has a means for draining moisture from the means for aligning one tile with another, which comprises an edge of the front surface. The edge slopes from the flange to the front plane.

This invention provides a tile for covering a wall surface, which is self-aligning, does not require the use of grout and drains moisture from a joint of adjacent tiles. In a preferred embodiment, each tile is 60 inches long to match the length of a standard bathtub for easy installation in a bathroom along the bathtub.

DETAILED DESCRIPTION OF THE INVENTION

Figure 1:
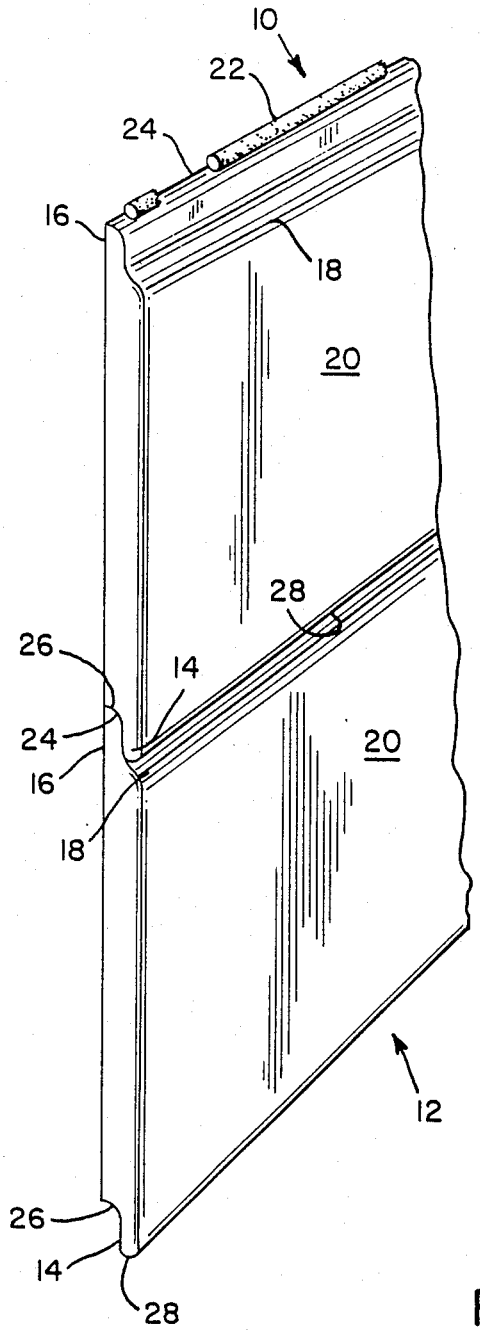
FIG. 1 shows a partial perspective view of two overlapping tiles.

FIG. 1 shows an elongated tile 10 which overlaps another elongated tile 12. These tiles 10 and 12 are typical of many tiles which overlap to cover an entire wall surface. However, only two such tiles are shown for simplicity.

Tile 10 has a lip 14 which extends down from the tile 10 and overlaps a flange 16 of the tile 12. The lip 14 runs the entire length of the tile 10. The flange 16 runs the entire length of the tile 12. Each tile 10 and 12 has an edge 18 that is part of a front surface 20 of each tile and which slopes downward from the flange 16. A bead of mastic 22 or other suitable moisture sealant also runs the length of the tile 10 or 12 between adjacent tiles.

During application of tiles such as 10 and 12, a worker first applies an adhesive to a wall and levels and sets the tile 12 into the adhesive. The worker then runs a bead of mastic 22 along a top surface 24 of the tile 12. The worker next places the tile 10 so that a bottom surface 26 of the tile 10 abuts the top surface 24 of the tile 12. The abutting of the bottom surface 26 and the top surface 24 aligns the entire tile 10 with the tile 12 and slightly compresses the mastic 22. The lip 14 overlaps the flange 16. The worker then sets another tile to overlap the tile 10 and continues setting additional tiles until the worker covers the entire wall.

Grouting of joints between the tiles 10 and 12 is not necessary, because the tiles overlap and the mastic seals these joints to keep moisture from seeping behind the tiles. The edge 18 has two oppositely turning curves comprising a smooth "S" curve of the front surface 20. This edge 18 carries any moisture or water away from a joint of the lip 14 and flange 16 and down the front surface 20 of the tiles. The edge slopes or curves sufficiently so that moisture will not accumulate adjacent the flange 16 or behind the lip 14.

Figure 2:
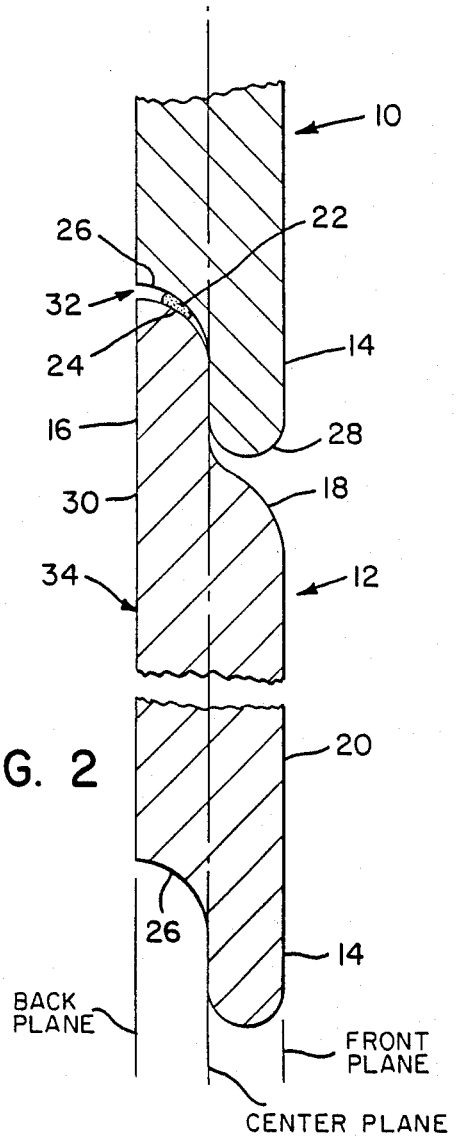
FIG. 2 shows a sectional side view of portions of overlapping tiles.

FIG. 2 shows a sectional side view of portions of overlapping tiles. The bottom surface 26 of the upper tile 10 abuts the top surface 24 of the lower tile 12. The flange 16 and lip 14 have approximately equal thicknesses. The flange 16 extends upward from the tile 12 a distance which is approximately equal to the distance the lip 14 extends downward from the tile 10. In other embodiments, the flange 16 may extend farther than the lip 14. It is only necessary that the top surface 24 of the flange 16 abut the bottom surface 26 of the tile 10 and that the lip 14 extend somewhat over the flange 16. The lip 14 has a finished, rounded 28. It is not necessary or desirable that the rounded edge 28 touch or contact the edge 18.

The front surface 20 of each tile sits in a front plane. The front surface 20 is the finished surface of a tile, which is exposed to view and moisture. A back surface 30 of each tile sits in a back plane. The back surface 30 is the unfinished surface of a tile which is not exposed to view or moisture and which is adhered to a wall. A center plane sits equidistant between the back plane and front plane and is parallel to those planes.

Each tile 10 or 12 comprises a body 34. The flange 16 extends upward from the body 34 and between the back plane and center plane. The lip 14 extends downward from the body 34 between the center plane and the front plane. The edge 18 is integral with the front surface 20 and slopes down from the flange 16. The top surface 24 is an edge that curves downward from the back surface 30 toward the center plane. The bottom surface 26 is a recess that curves upward from the lip 14 to the back surface 30. Thus the top surface 24 and the bottom surface 26 comprise complementary surfaces. Adjacent tiles 10 and 12 overlap such that the lip 14 and flange 16 touch approximately at the center plane. However, a bead of mastic 22 or moisture sealant between the top surface 24 and the bottom surface 26 slightly separates adjacent tiles vertically.

A separation 32 between adjacent tiles is large in FIG. 2, for clarity. The separation 32 can be very small. It is necessary that some minimal separation exist between the top surface 24 and the bottom surface 26 to receive a moisture sealant, such as mastic 22. The separation 32 and mastic 22 allow for expansion and contraction of the tiles 10 and 12 caused by temperature changes.

Figure 3:
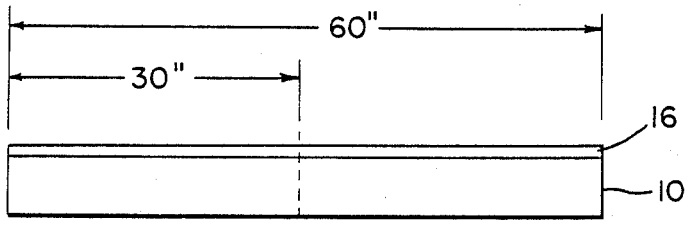
FIG. 3 shows a front view of a 60-inch tile.

FIG. 3 shows a side view of a tile 10 in a preferred embodiment. The tile 10 is 60 inches long. Standard bathtubs are also 60 inches long. Thus, a tile 60 inches long fits and covers a full length of a wall adjacent and along a standard bathtub. Standard bathtubs are 30 inches wide. Thus, a 60 inches long tile can be cut in half into tiles 30 inches long. A tile 30 inches long fits and covers wall sections adjacent ends of a standard bathtub. It is very easy to align these long tiles atop one another, compared to aligning small, square tiles atop and next to one another.

Alternately, tiles can be made which are 30 inches long. Such tiles fit at the ends of a standard bathtub. Two abutting tiles fit along the length of a standard bathtub. However, a moisture sealant must be used where these tiles abut. Also, a tile 30 inches long fits along the walls of a standard shower stall. A tile 48 inches long fits along the walls of a larger shower stall.

Figure 4:
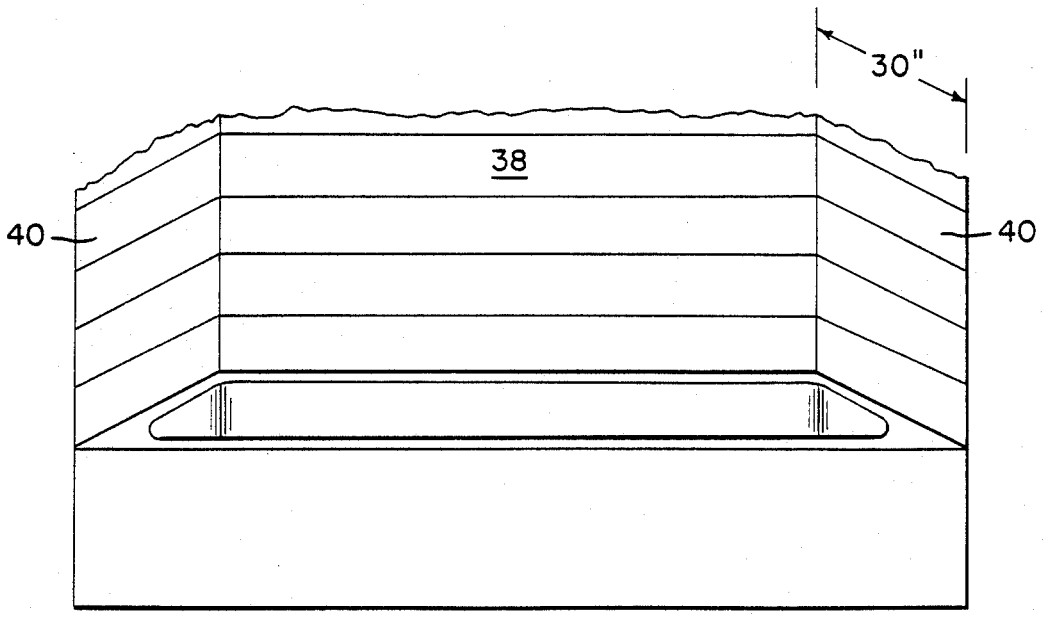
FIG. 4 shows tiles in place along a bathtub.

FIG. 4 shows tiles in place along a standard bathtub 36. Whole tiles 38 are 60 inches long and run the full length of the standard bathtub 36. Half-tiles 40 run the width of the standard bathtub 36 at the ends of the bathtub. The tiles 38 and 40 can comprise ceramic or plastic materials, and can have ornamentation or design on the front surfaces of those tiles.

Applicant's invention provides a new tile which is self-aligning, does not require grouting, and is sized to a fit around a standard bathtub.

I claim:

1. A ceramic tile comprising:

a body having a back surface in a back plane, a front surface in a front plane, and a center plane between and parallel to the back plane and the front plane;

a means for aligning one tile with another tile, which comprises:

a flange extending from the body having a first surface in the back plane connected to the back surface of the body, a second surface in the center plane, and a top surface joining the first surface to the second surface in a smooth curve of only one direction;

a lip extending from the body in a direction opposite of the flange, having a third surface in the center plane, a fourth surface in the front plane connected to the front surface of the body, and a rounded edge joining the third surface to the fourth surface in a smooth curve of only one direction; and a bottom surface comprising a recess complementary to the top surface and joining the third surface to the back surface of the body, wherein the top surface of a flange of a first ceramic tile comprises a means for abutting the bottom surface joining the lip of a second ceramic tile such that the flange of first ceramic tile is adjacent the lip of the second ceramic tile and the back surface of the first ceramic tile is coplanar with the back surface of the second ceramic tile;

and a means for draining moisture from the means for aligning, which comprises an edge of two oppositely turning curves joining the second surface of the flange to the front surface of the body.

2. The tile of claim 1, the flange extending at least as far from the body as the lip.

3. The tile of claim 2, having a length of 60 inches.

4. The tile of claim 2, consisting of a length of 60 inches.

5. The tile of claim 2, having a length of 30 inches.

6. The tile of claim 2, consisting of a length of 30 inches.

7. A vinyl tile comprising:

a body having a back surface in a back plane, a front surface in a front plane, and a center plane between and parallel to the back plane and the front plane;

a means for aligning one tile with another tile, which comprises:

a flange extending from the body having a first surface in the back plane connected to the back surface of the body, a second surface in the center plane, and a top surface joining the first surface to the second surface in a smooth curve of only one direction;

a lip extending from the body in a direction opposite of the flange, having a third surface in the center plane, a fourth surface in the front plane connected to the front surface of the body, and a rounded edge joining the third surface of the fourth surface in a smooth curve of only one direction; and a bottom surface comprising a recess complementary to the top surface and joining the third surface to the back surface of the body, wherein the top surface of a flange of a first vinyl tile comprises a means for abutting the bottom surface joining the lip of a second vinyl tile such that the flange of the first vinyl tile is adjacent the lip of the second vinyl tile and the back surface of the first vinyl tile is coplanar with the back surface of the second vinyl tile;

and a means for draining moisture from the means for aligning, which comprises an edge of two oppositely turning curves joining the second surface of the flange to the front surface of the body.

8. The tile of claim 7, the flange extending at least as far from the body as the lip.

9. The tile of claim 8, having a length of 60 inches.

10. The tile of claim 8, consisting of a length of 60 inches.

11. The tile of claim 8, having a length of 30 inches.

12. The tile of claim 8, consisting of a length of 30 inches.

* * * * *